US005190235A

United States Patent [19]

Schönmeier et al.

[11] Patent Number: 5,190,235

[45] Date of Patent: Mar. 2, 1993

[54] DRUM-TYPE WINDER FOR WINDING WEBS OF MATERIAL

[75] Inventors: Herbert Schönmeier; Luzian Kies, both of Düsseldorf, Fed. Rep. of Germany

[73] Assignee: Jagenberg Aktiengesellschaft, Dusseldorf, Fed. Rep. of Germany

[21] Appl. No.: 895,175

[22] Filed: Jun. 5, 1992

Related U.S. Application Data

[63] Continuation of Ser. No. 530,365, May 30, 1990, abandoned.

[30] Foreign Application Priority Data

Jul. 26, 1989 [DE] Fed. Rep. of Germany ..... 3924612

[51] Int. Cl.[5] ..... B65H 18/20

[52] U.S. Cl. ..... 242/66

[58] Field of Search ..... 242/65, 66, 56.2

[56] References Cited

U.S. PATENT DOCUMENTS 4,180,216 12/1979 Dahl et al. ..... 242/66
4,598,877 7/1986 Oinonen ..... 242/66
4,883,233 11/1989 Saukkonen et al. ..... 242/66
4,969,609 11/1990 Scheuter ..... 242/66

FOREIGN PATENT DOCUMENTS 3207461 9/1983 Fed. Rep. of Germany .
2522631 9/1983 France .

OTHER PUBLICATIONS

Patent Abstracts of Japan, vol. 8, No. 136 (M-304), 23 Jun. 1984, & JP-A-59-036057, 19 Aug. 1982.
Patent Abstracts of Japan, vol. 6, No. 216 (M-168), 29 Oct. 1982, & JP-A-57-121547 (Mitsubishi Jukogyo) 20 Jan. 1981.

*Primary Examiner*—John M. Jillions
*Attorney, Agent, or Firm*—Sprung, Horn, Kramer & Woods

[57] ABSTRACT

A drum-type winder for winding webs (5) of material, especially webs of paper, with two drums that the reels rest against while being wound. The winder has a freely rotating attenuating roller (12) that extends across the operating width, that can be applied more or less horizontally to the reels (4.1 & 4.2), and that can be forced away from the reels in opposition to an adjustable force.

18 Claims, 1 Drawing Sheet

DRUM-TYPE WINDER FOR WINDING WEBS OF MATERIAL

Figure 1:
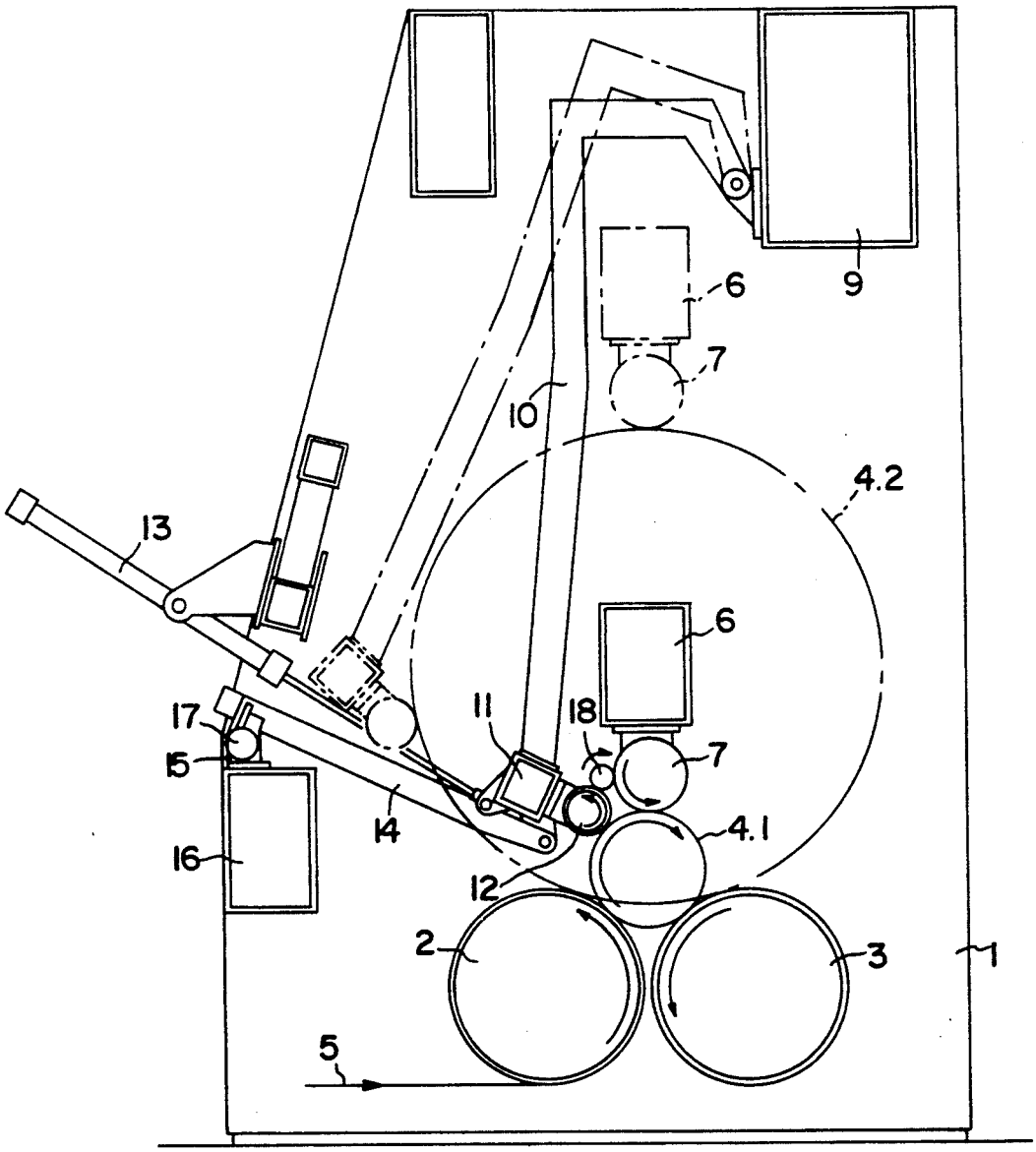

This application is a continuation of application Ser. No. 530,365, filed May 30, 1990, now abandoned.

The invention concerns a drum-type winder for winding webs of material, especially webs of paper.

Experience demonstrates that reels, especially reels of soft paper, wound on the generic drum-based winder known from German OS 3 207 461 are often not round and will accordingly tend to jump around between the two drums while being wound. The motion leads to irregular winding. Oscillations increase the activity and soon lead to rips in the web. In extreme cases the reels will leap out of the bed.

The present invention is intended to provide a generic drum-type winder that will ensure smooth winding of even soft types of paper.

This object is attained in accordance with the invention which starts with a two-drum winder against which the reels rest while being wound. There is provided a freely rotating roller (12) that extends across the operating width, means for applying the attenuating roller approximately horizontally to the reels (4.1 & 4.2), and means for forcing the attenuating roller away from the reels in opposition to an adjustable force.

By making the magnitude of the adjustable force independent of distance, it is independent of the diameter of the reel. Such force can be generated by friction.

The attenuating roller may be secured to pivoting arms articulated to a frame above the winding site.

There may be provided a braking strip secured to the pivoting arms and subject to a braking mechanism.

The attenuating roller may be divided into individually mounted segments secured to a common transverse pivoting arm. The roller can be long and still rigid even though it has a very short diameter. The attenuating roller may be accelerated to the circumferential velocity of the reel before coming into contact with it. This measure prevents relative motions that could cause the web to rip when contact is established with the reel.

One embodiment of the invention will now be described with reference to the highly schematic drawing, the single figure in which is a side view of a drum-based winder in accordance with the invention.

Mounted in the frame 1 of a winder are two driven drums 2 and 3, against which reels 4.1 and 4.2 rest during the winding process. A web 5 of material, preferably of paper and slit longitudinally into subsidiary webs, is deflected up by drum 2, fed into the bed between the drums, and wound on aligned cores. Mounted such that it can be moved up and down in frame 1 is an arm 6 that extends over the operating width. Secured to the bottom of arm 6 is a freely rotating rider 7. Rider 7 rests against the apical line of reel 4.1 and presses down on the reel. The result extra weight on drums 2 and 3 increases the tightness of reel 4.1 until it becomes heavy enough to ensure its own tightness A double-drum winder of this type is known from German OS 3 207 461 for example.

Mounted on each side of the winder on an upper transverse arm 9 on frame 1 is a pivoting arm 10. Both pivoting arms 10 terminate at a distance above drums 2 and 3. They support a transverse pivoting arm 11 that extends over the operating width. An attenuating roller 12 rotates freely on the end of transverse pivoting arm 11 that faces reel 4.1. Pivoting arms 10 are designed to force attenuating roller 12 more or less horizontally against reel 4.1 while the reel still has a short diameter and to pivot back into an inactive position out of the vicinity of a full reel 4.2. The pivoting motion is caused by two piston-and-cylinder mechanisms 13 on each side, secured to both frame 1 and to transverse pivoting arm 11.

Articulated to each end of transverse pivoting arm 11 is a braking strip 14, the free end of which extends out and rests in guides 15, which are secured to another arm 16 on frame 1. Accommodated in guides 15 are friction structures in the form of braking tongs 17 that can be subjected to varying pressure and that in conjunction with braking strips 14 counteract in the capacity of a disk variably brake the pivoting motion of attenuating roller 12.

Attenuating roller 12 is either a throughgoing roll or divided into individually mounted segments, each approximately 1 meter long. Each segment in this embodiment is in circumferential contact with at least one friction wheel 18. Friction wheels 18, which are mounted coaxial and also rotate freely on transverse pivoting arm 11, are positioned such that, before attenuating roller 12 comes to rest against the growing reel 4.1, friction wheels 18 will come into contact with rider 7, which rests against the reel. Rider 7 starts friction wheels rotating, and the wheels accelerate attenuating roller 12 to the circumferential velocity of reel 4.1. eliminating any difference in motion when they come into contact. Friction wheels 18 can be left out if the difference in velocity that occurs with the acceleration of attenuating roller 12 has no detrimental effects. To eliminate as much inertia as possible, attenuating roller 12 is as light in weight as possible, and is preferably made out of aluminum.

How the drum-type winder in accordance with the invention operates will now be described.

Once the winding process has been commenced, arms 10 are pivoted along with attenuating rollers 12 into the position that corresponds to the diameter of reel 4.1 at which the attenuation is supposed to take effect. The desired friction is established on braking strips 14 with braking tongs 17, generating the resistance that is to counteract the motion of reel 4.1 or 4.2 away from drum 3. Before the diameter of the reel increases to the extent that the reel comes into contact with attenuating roller 12, the roller is accelerated by the rider 7 that rests against it and by friction wheels 18 to the same circumferential velocity. The growing reel 4.1 or 4.2 will then exert a radial and outward force against the resistance of braking tongs 17. The resistance can be adjusted to the desired level. It prevents reels 4.1 and 4.2 from turning irregularly and accordingly ensures uniform contact on the part of the reels and smooth winding.

It will be understood that the specification and examples are illustrative but not limitative of the present invention and that other embodiments within the spirit and scope of the invention will suggest themselves to those skilled in the art.

What is claimed is:

1. In a drum-type winder for winding webs of material, such as paper, comprising two drums against which a reel rests while being wound with the webs, the improvement which comprises a freely rotating attenuating roller (11) that extends across the operating width of the drums, means for applying the attenuating roller approximately horizontally to the reel (4.1), means for applying an adjustable force forcing the attenuating roller towards the reel in an essentially horizontal direction, and a rider that moves up and down above the drums, the attenuating roller (12) being in circumferential contact with friction wheels (18) that rest against the rider (7) before the reel (4.1) comes into contact with the attenuating roller.

2. A drum-type winder according to claim 1, wherein the magnitude of the adjustable force is independent of distance.

3. A drum-type winder according to claim 2, wherein the adjustable force is friction.

4. A drum-type winder according to claim 1, wherein the attenuating roller (12) is secured to the pivoting arms (10) articulated to a frame (1) above the winding site.

5. A drum-type winder according to claim 4, including a rider (7) positioned to ride on a reel being wound, and means (6) supporting said rider independently of the pivoting arms (10).

6. A drum-type winder according to claim 1, including a braking strip (14) secured to pivoting arms (10) and a braking mechanism (17) for braking the strip, the braking strip serving to brake the pivoting motion of the attenuating roller.

7. A drum-type winder according to claim 1, wherein the attenuating roller (12) is divided into longitudinally mounted segments secured to a common transverse pivoting arm (11).

8. A drum-type winder according to claim 1, wherein the attenuating roller (12) is a throughgoing roll secured to a transverse pivoting arm (11).

9. A drum-type winder according to claim 1, wherein the attenuating roller (12) is a throughgoing roll.

10. In a drum-type winder for winding webs of material, such as paper, comprising two drums against which a reel rests while being wound with the webs, the improvement which comprises a freely rotating attenuating roller (12) that extends across the operating width of the drums, means for applying the attenuating roller approximately horizontally to the reel (4.1), a braking strip (14) secured to pivoting arms (10) which secures the attenuating roller for pivoting motion and a braking mechanism (17) for braking the strip with an adjustable force, the braking strip serving to brake the pivoting motion of the attenuating roller.

11. A drum-type winder according to claim 10, wherein the magnitude of the adjustable force is independent of distance.

12. A drum type winder according to claim 11, wherein the adjustable force is friction.

13. A drum type winder according to claim 10, wherein the pivoting arms (10) are articulated to a frame (1) above the winding site.

14. A drum type winder according to claim 13, including a rider (7) positioned to ride on a reel being wound, and means (6) supporting said rider independently of the pivoting arms (10).

15. A drum type winder according to claim 10, including a rider that moves up and down above the drums, the attenuating roller (12) being in circumferential contact with friction wheels (18) that rest against the rider (7) before the reel (4.1) comes into contact with the attenuating roller.

16. A drum type winder according to claim 10, wherein the attenuating roller (12) is divided into individually mounted segments secured to a common transverse pivoting arm (11).

17. A drum type winder according to claim 10, wherein the attenuating roller (12) is a throughgoing roll secured to a transverse pivoting arm (11).

18. A drum type winder according to claim 10, wherein the attenuating roller (12) is a throughgoing roll.

* * * * *